US005184970A

United States Patent [19]

Binkley

[11] Patent Number: 5,184,970

[45] Date of Patent: Feb. 9, 1993

[54] ACTION TOY USING MAGNETIC MARBLES

[76] Inventor: Dennis E. Binkley, 10706 12th Ave. NW., Seattle, Wash. 98177

[21] Appl. No.: 835,209

[22] Filed: Feb. 13, 1992

[51] Int. Cl.[5] ..... A63H 33/26

[52] U.S. Cl. ..... 446/132; 446/138; 446/465; 335/285

[58] Field of Search ..... 446/138, 137, 139, 129, 446/132–135, 465; 434/301; 335/285, 302, 306; 273/239, 456

[56] References Cited

U.S. PATENT DOCUMENTS 2,557,399 6/1951 Teetor ..... 335/285 X
3,965,613 6/1976 Saunders ..... 446/132

FOREIGN PATENT DOCUMENTS 488746 1/1930 Fed. Rep. of Germany ..... 446/139
2340606 8/1974 Fed. Rep. of Germany ..... 446/138
2123306 2/1984 United Kingdom ..... 446/92

*Primary Examiner*—Mickey Yu

[57] ABSTRACT

The magnetic marble action toy includes a design member (12) which may take the form and the image of a variety of animals and/or vehicles, or other elements, such as numbers or letters. The design member (12) is typically made of flat plastic and includes one or more openings (18) therethrough. Two magnetic marbles (30, 32) are positioned on opposite sides of the design member, in physical contact with each other through the opening (18). The opening (18) is arranged relative to the magnetic marbles (30, 32) such that the magnetic marbles (30, 32) spin freely while supporting the design member in an upright position, so that the toy may be readily propelled in various directions by the user.

9 Claims, 2 Drawing Sheets

FIG. 1
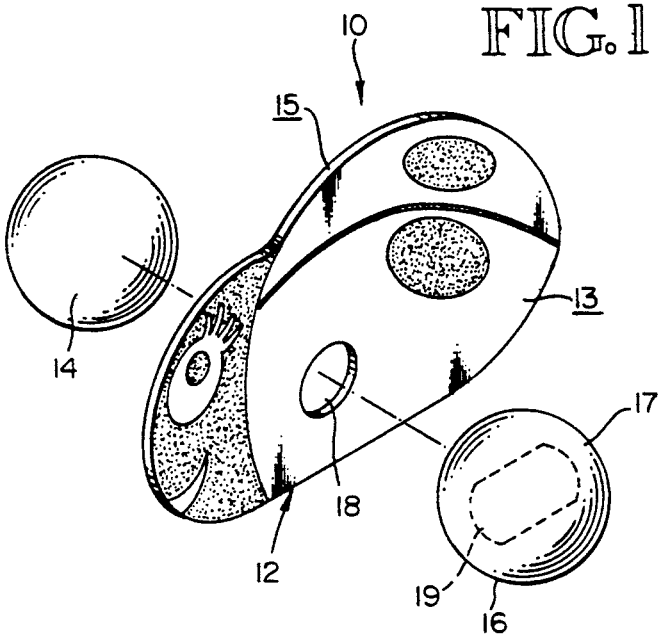
FIG. 6
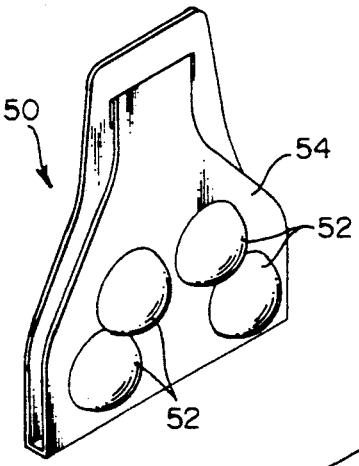
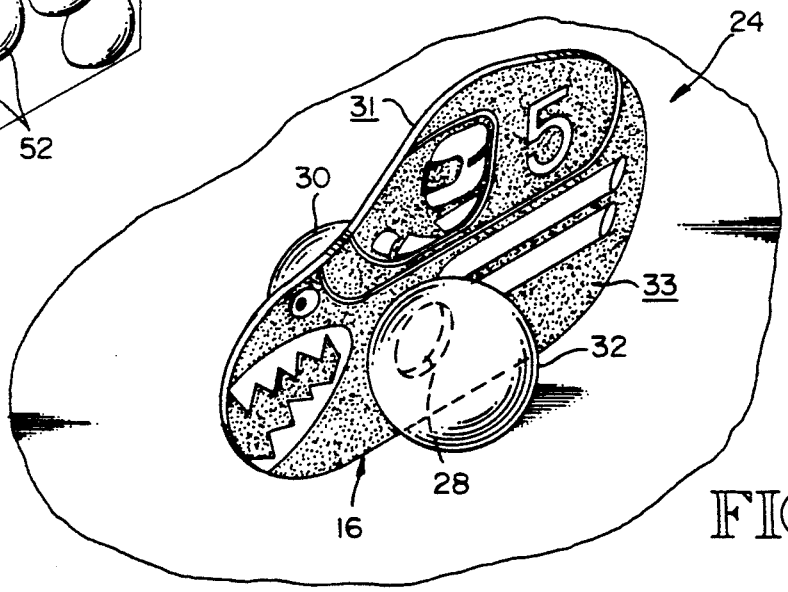
FIG. 2

ACTION TOY USING MAGNETIC MARBLES

TECHNICAL FIELD

This invention relates generally to the toy art and more specifically concerns an action toy which includes magnetic marbles.

BACKGROUND OF THE INVENTION

An important part of the diverse toy art are those toys referred to generally as action toys, which are designed and/or constructed to be moved about in some action sequence by the user, either alone or in combination with similar toys. Such toys are popular because they are readily adaptable to the imagination of the user, in a wide variety of circumstances. Most children simply enjoy the action aspect of toys.

In addition, it is recognized that toys can be used advantageously in different circumstances as a learning tool, in which the toy itself and/or the use thereof provides information to the user concerning certain physical and/or mechanical principles and phenomenon.

A toy which is both action oriented and capable of providing information is usually quite popular with both users and those who purchase the toys. The present invention involves a plurality of simple design members which are combined with one or more pairs of magnetic marbles. The combination of the design member and the magnetic marbles is a simple action toy which is fun to use, is adaptable to the imagination of the user, yet also provides a means for learning some interesting scientific principles.

SUMMARY OF THE INVENTION

Accordingly, the invention is a toy which includes magnetic marbles, comprising: a design member which has an image thereon, the design member having an opening therethrough; at least one set of two magnetic marbles, positioned on both sides of the design member and in contact with each other through the opening, wherein the opening is positioned so that the marbles, when in contact with a support surface, such as a table, maintain the design member in a selected position, and wherein the marbles are free to rotate relative to each other and the design member about a magnetic axis so that the toy may be propelled in various directions.

BRIEF DESCRIPTION OF THE DRAWINGS

FIG. 1 is an exploded perspective view showing the magnetic marble toy of the present invention, with an animal design element.

FIG. 2 is a perspective view of the magnetic marble toy of the present invention, with a vehicle design element.

FIG. 6 is a schematic view showing a power booster element which can be used with the magnetic marble toys of FIGS. 1-5.

BEST MODE FOR CARRYING OUT THE INVENTION

Figure 3:
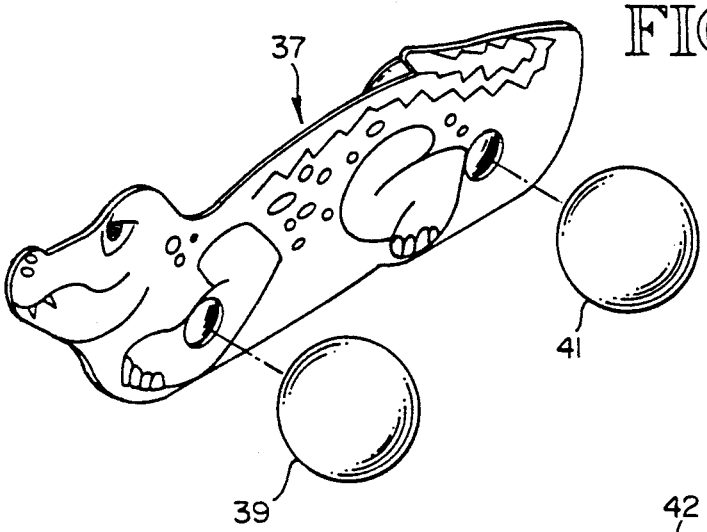
FIG. 3 is a perspective view of an alternative embodiment using two sets of magnetic marbles.

FIGS. 1 and 2 show two closely related embodiments of the magnetic marble action toy of the present invention. FIG. 1 shows the magnetic marble toy in the form of an animal, while FIG. 2 shows the toy in the form of a vehicle. Referring to FIG. 1, the magnetic marble toy, shown generally at 10, comprises three basic elements, including a central design member 12 and two magnetic marbles 14 and 16 arranged on opposite sides of the design member. In the embodiment shown in FIG. 1, design member 12 is a flat piece of plastic, approximately 0.035 inch thick, having the configuration and the image of an animal, in this case, a ladybug. The image of the ladybug appears on both sides 13, 15 of the design member 12. It should be understood that a large variety of animal and/or insect designs can be used, including, among others, bees, butterflies, spiders and frogs. Combinations of two or more such animals can be used to provide a "chase" aspect of the action toy, including a cat/mouse set, a turtle/rabbit set, a duck/alligator set, etc.

Design member 12 has a single opening 18 therethrough. The opening 18 in the embodiment shown matches the size of the marbles 14 and 16, and has a diameter of approximately 15/64 inch for the marbles of FIG. 1, which have a diameter of $\frac{5}{8}$ inch, for example. The lowermost edge portion of opening 18 is located approximately $\frac{1}{4}$ inch from the bottom of the design member 12. In the embodiment of FIGS. 1 and 2, the opening 18 is positioned at the balance point, i.e., the midpoint, of the design member. This is particularly significant in those embodiments having a single magnetic axle comprising two magnetic marbles.

The magnetic marbles 14, 16 are conventional, and comprise a plastic outer shell 17 with a magnetic element 19 positioned inside, with the magnetic element 19 having north and south poles at the opposite ends thereof. The marbles 14, 16 are positioned so that they are in physical contact with each other, on opposite sides of design member 12, through opening 18. The arrangement and position of opening 18 relative to design member 12 and the two magnetic marbles 14, 16 is such that the marbles are capable of spinning freely about a magnetic axis defined by a line extending through the point of contact between the two marbles and the centers of the respective marbles. There should be no appreciable friction between design member 12 and the magnetic marbles 14, 16 as the marbles rotate, when the toy is positioned on a surface such as a floor or table and moved therealong.

FIG. 2 shows an embodiment similar to that of FIG. 1, except the design member, instead of being an insect or an animal, is in the form of a racing vehicle. The embodiment of FIG. 2 generally shown at 24 comprises a central design member 26, with a midpoint balance opening 28 therein, and two magnetic marbles 30 and 32 in physical contact with each other through opening 28. The design member has the outline of a racing vehicle, with the image of such a vehicle on the opposite surfaces 31, 33 thereof. Variations of the vehicle in FIG. 2 are of course possible.

In use, the magnetic marble action toy may be propelled forwardly or backwardly by initially holding the top of the design member with the fingers and then pushing or pulling the toy either forwardly or backwardly. When the toy is let go, it continues for a short distance, by virtue of the revolution of the marbles.

Figure 4:
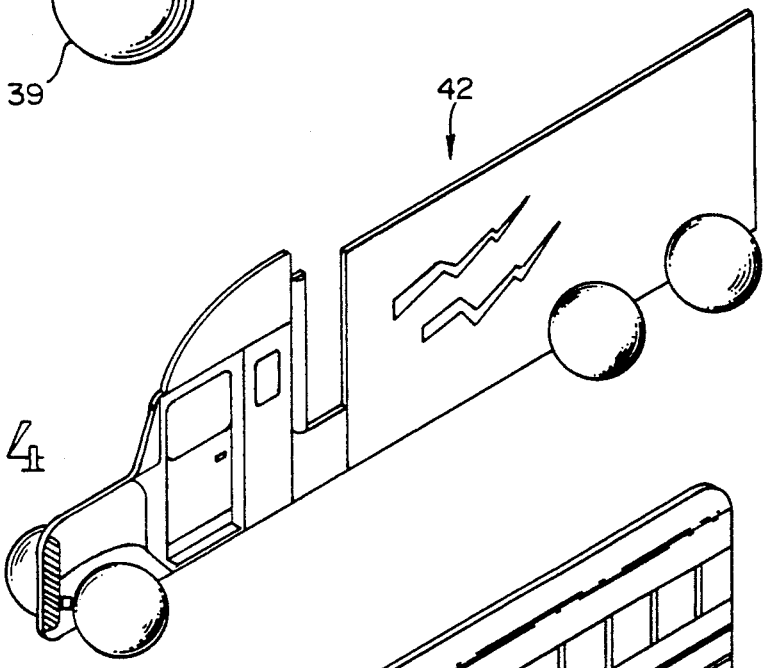
FIG. 4 is a perspective view of an alternative embodiment in the form of a tractor trailer.

One variation of the embodiments of FIGS. 1 and 2 involves multiple magnetic axles, instead of one. This is illustrated in the embodiment of FIG. 3, which shows an alligator having "axles" at the front and rear ends thereof. The alligator includes a design member 37 and two sets of magnetic marbles 39 and 41, each set comprising two marbles. FIG. 4 shows a tractor-trailer vehicle 42 comprising a tractor and a joined trailer and 3 sets of magnetic marbles, each pair of which forms a separate magnetic axle. When more than one axle is used, such as in the embodiments of FIGS. 3 and 4, the position of the axles relative to the design member is not quite as important as for the single axle, since balancing the design member is easily accomplished with two or more axles. While the double-axle embodiment may be more common for vehicles, it also can be used with respect to numerous animals, such as a rabbit, dog, etc.

Figure 5:
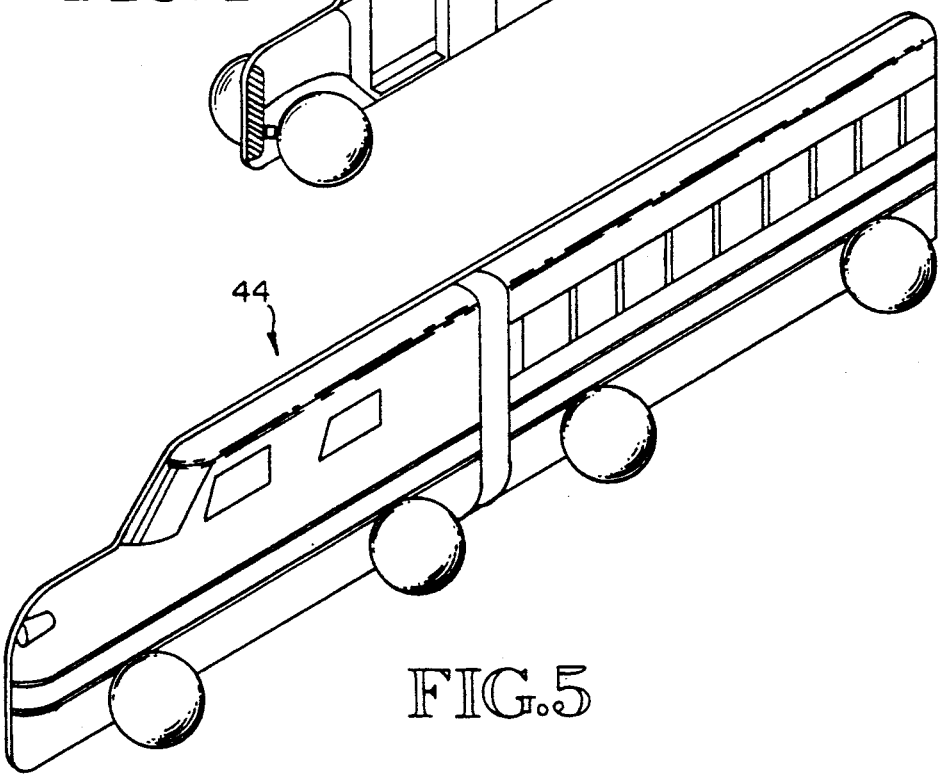
FIG. 5 is a perspective view of an alternative embodiment in the form of a train.

FIG. 5 shows a further embodiment which has an extended design member in the form of a passenger train, shown generally at 44. The passenger train can include a number of separate design members connected movably together or a long single member. The train will have a plurality of magnetic axles, each axle formed by two opposing marbles in physical contact with each other, with the actual number of axles depending upon the length of the train, i.e. the number of cars in the train.

FIG. 6 shows an accessory which can be conveniently used with the magnetic marble toys of FIGS. 1-5. This accessory is referred to as a power pack or booster, and is shown at 50. The power pack 50 comprises a set of magnetic marbles, 52-52, positioned in a plastic holder 54. One arrangement, but not necessarily the only one, includes four magnetic marbles joined together and arranged in semi-circle. This arrangement is shown in FIG. 6. The curved arrangement of FIG. 6 tends to focus the magnetic effect and increase it at a particular point relative to the effect of a straight line of marbles. The plastic holder 54 may take various shapes, but will typically include a portion which holds the magnetic marbles 52-52 in place in the holder, while another portion is configured so that the holder may be easily gripped by the user.

The power pack or booster 50, when positioned by the user slightly above a particular magnetic marble toy, can cause the toy to spin and move in various directions under the direction of the user. It may be used from above the magnetic marble toy, or below it, such as through a table top on which the toy rests. The direction of movement of the toy, as well as the actual moving of the toy, is accomplished without physical contact between the toy and the power pack 50. The power pack increases the possible uses of the toy, and expands the possibility of joint, interactive play. With the power booster 50 held in one orientation, the action toy will be pushed along ahead of the power booster. If the power booster is then flipped over, the action toy will be drawn toward the power booster, thereby increasing the variety of action available.

While FIG. 6 shows a four marble booster, other arrangements could be used, involving a greater number or smaller number of marbles, including a two marble embodiment. The four marble arrangement is used primarily with multiple axle embodiments while the two marble arrangement is used with single axle embodiments.

It should be understood that besides the specific types of design members discussed above, i.e., certain animals and/or vehicles, a number of other possibilities can be used, including, for instance, additional animals, such as dinosaurs, various fish, farm animals and jungle animals. Further, the design member may take the form of either letters, which may then be conveniently grouped by the user into various words, and/or even numbers. Still further, the design members could be people, including for example, ballerinas or clowns, among others.

Although a preferred embodiment has been disclosed for purposes of illustration, it should be understood that various changes, modifications and substitutions may be incorporated in such embodiment without departing from the spirit of the invention, which is defined by the claims which follow:

What is claimed is:

1. A toy using magnetic marbles, comprising:

a design member having an image thereon, with an opening therethrough;

at least one set of two magnetic marbles, positioned on both sides of the design member and in contact with each other through the opening, wherein the opening is positioned so that the marbles, when in contact with a support surface such as a table, maintain the design member in a selected position, and wherein the marbles are free to rotate relative to each other and the design member, about a magnetic axis, so that the toy may be propelled easily in various directions.

2. An article of claim 1, wherein the design member is configured and has the image of an animal.

3. An article of claim 1, wherein the design member has the image and configuration of a vehicle.

4. An article of claim 1, wherein the design member has the image and configuration of a human being.

5. An article of claim 1, wherein the design member includes more than one opening, and more than one set of magnetic marbles, each set of magnetic marbles maintaining physical contact, respectively, through one of said openings, thereby defining more than one magnetic axis for the design member.

6. An article of claim 1, wherein the design member is a flat plastic member.

7. An article of claim 6, wherein the design member is approximately 0.035 inch thick, and wherein the magnetic marbles are approximately one-half inch in diameter, and wherein the opening is approximately 15/64 inch in diameter and approximately ¼ inch from the lower edge of the design member.

8. An article of claim 1, including a power pack associated with the toy, for use in propelling the toy without physical contact therewith, the power pack including a plurality of magnetic- marbles in contact with each other and a member configured to hold the magnetic marbles in place together in a selected arrangement.

9. An article of claim 8, wherein the selected arrangement is a curve, such that the magnetic effect tends to be focused, and wherein the plurality of magnetic marbles includes at least four marbles.

* * * * *